US009816249B2

(12) United States Patent
Padilla

(10) Patent No.: US 9,816,249 B2
(45) Date of Patent: Nov. 14, 2017

(54) EXCAVATING IMPLEMENT HEADING CONTROL

(71) Applicant: Caterpillar Trimble Control Technologies LLC, Dayton, OH (US)

(72) Inventor: Christopher A. Padilla, Chillicothe, IL (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 50 days.

(21) Appl. No.: 15/013,044

(22) Filed: Feb. 2, 2016

(65) Prior Publication Data

US 2017/0218595 A1 Aug. 3, 2017

(51) Int. Cl.
*E02F 3/43* (2006.01)
*E02F 9/20* (2006.01)
(Continued)

(52) U.S. Cl.
CPC ..... *E02F 3/439* (2013.01); *E02F 3/30* (2013.01); *E02F 3/43* (2013.01); *E02F 3/431* (2013.01);
(Continued)

(58) Field of Classification Search
CPC ..... E02F 3/30; E02F 3/439; E02F 3/43; E02F 3/431; E02F 3/435; E02F 9/2025;
(Continued)

(56) References Cited

U.S. PATENT DOCUMENTS 7,293,376 B2 11/2007 Glover
7,578,079 B2 8/2009 Furem
(Continued)

FOREIGN PATENT DOCUMENTS

RU 2032029 C1 3/1995
RU 2572443 C2 1/2016
WO 2014209209 A1 12/2014

OTHER PUBLICATIONS

Makkonen et al., "A 3D model based control of an excavator", Automation in Construction 15, pp. 571-577, 2006.
(Continued)

*Primary Examiner* — Dale W Hilgendorf
(74) *Attorney, Agent, or Firm* — Dinsmore & Shohl LLP

(57) ABSTRACT

An excavator comprises a chassis, an implement, and an assembly comprising a boom, a stick, and a coupling. The assembly is configured to define a heading $\hat{N}$ and to swing with, or relative to, the chassis about a swing axis S. The stick is configured to curl relative to the boom about a curl axis C. The implement is coupled to a stick terminal point G via the coupling and is configured to rotate about a rotary axis R such that a leading edge of the implement defines a heading $\hat{I}$. An excavator control architecture comprises sensors and machine readable instructions to generate signals representative of $\hat{N}$, an assembly swing rate $\omega_S$ about S, and a stick curl rate $\omega_C$ about C, generate a signal representing a terminal point heading $\hat{G}$ based on $\hat{N}$, $\omega_S$, and $\omega_C$, and rotate the implement about R such that $\hat{I}$ approximates $\hat{G}$.

20 Claims, 4 Drawing Sheets

(51) Int. Cl.
*E02F 3/30* (2006.01)
*E02F 9/26* (2006.01)

(52) U.S. Cl.
CPC ..... *E02F 3/435* (2013.01); *E02F 9/2025* (2013.01); *E02F 9/2037* (2013.01); *E02F 9/2041* (2013.01); *E02F 9/264* (2013.01); *E02F 9/265* (2013.01)

(58) Field of Classification Search
CPC ..... E02F 9/2037; E02F 9/2041; E02F 9/264; E02F 9/265
See application file for complete search history.

(56) References Cited

U.S. PATENT DOCUMENTS

| | | | | |
|---|---|---|---|---|
| 7,734,398 | B2 | 6/2010 | Manneppalli | |
| 7,810,260 | B2 * | 10/2010 | Pope | E02F 3/435 701/50 |
| 7,869,923 | B2 | 1/2011 | Kawaguchi | |
| 8,689,471 | B2 | 4/2014 | Carpenter et al. | |
| 8,862,340 | B2 * | 10/2014 | Andruch, III | E02F 9/2025 701/50 |
| 9,464,405 | B2 * | 10/2016 | Friend | E02F 9/2025 |
| 2008/0000111 | A1 | 1/2008 | Green | |
| 2008/0047170 | A1 | 2/2008 | Nichols | |
| 2008/0065298 | A1 | 3/2008 | Kawaguchi | |
| 2014/0324291 | A1 | 10/2014 | Jones et al. | |

OTHER PUBLICATIONS

International Search Report and Written Opinion dated Jun. 1, 2017 pertaining to International Application No. PCT/US 2017/015719.

* cited by examiner

EXCAVATING IMPLEMENT HEADING CONTROL

BACKGROUND

The present disclosure relates to excavators which, for the purposes of defining and describing the scope of the present application, comprise an excavating implement that is subject to swing and curl control with the aid of an excavator boom and excavator stick, or other similar components for executing swing and curl movement. For example, and not by way of limitation, many types of excavators comprise a hydraulically or pneumatically controlled excavating implement that can be manipulated by controlling the swing and curl functions of an excavating linkage assembly of the excavator. Excavator technology is, for example, well represented by the disclosures of U.S. Pat. No. 8,689,471, which is assigned to Caterpillar Trimble Control Technologies LLC and discloses methodology for sensor-based automatic control of an excavator, US 2008/0047170, which is assigned to Caterpillar Trimble Control Technologies LLC and discloses an excavator 3D laser system and radio positioning guidance system configured to guide a cutting edge of an excavator bucket with high vertical accuracy, and US 2008/0000111, which is assigned to Caterpillar Trimble Control Technologies LLC and discloses methodology for an excavator control system to determine an orientation of an excavator sitting on a sloped site, for example.

BRIEF SUMMARY

According to the subject matter of the present disclosure, an excavator is provided comprising a machine chassis, an excavating linkage assembly, a rotary excavating implement, and control architecture. The excavating linkage assembly comprises an excavator boom, an excavator stick, and an implement coupling. The excavating linkage assembly is configured to define a linkage assembly heading $\hat{N}$ and to swing with, or relative to, the machine chassis about a swing axis S of the excavator. The excavator stick is configured to curl relative to the excavator boom about a curl axis C of the excavator. The rotary excavating implement is mechanically coupled to a terminal point G of the excavator stick via the implement coupling and is configured to rotate about a rotary axis R defined by the implement coupling such that a leading edge of the rotary excavating implement defines an implement heading $\hat{I}$. The control architecture comprises one or more dynamic sensors, one or more linkage assembly actuators, and one or more controllers programmed to execute machine readable instructions to generate signals that are representative of the linkage assembly heading $\hat{N}$, a swing rate $\omega_S$ of the excavating linkage assembly about the swing axis S, and a curl rate $\omega_C$ of the excavator stick about the curl axis C, generate a signal representing a directional heading $\hat{G}$ of the terminal point G of the excavator stick based on the linkage assembly heading $\hat{N}$, the swing rate $\omega_S$ of the excavating linkage assembly, and the curl rate $\omega_C$ of the excavator stick, and rotate the rotary excavating implement about the rotary axis R such that the implement heading $\hat{I}$ approximates the directional heading $\hat{G}$.

In accordance with one embodiment of the present disclosure, a method of automating tilt and rotation of a rotary excavating implement of an excavator comprises providing an excavator comprising a machine chassis, an excavating linkage assembly, a rotary excavating implement, and control architecture comprising one or more dynamic sensors, one or more linkage assembly actuators, and one or more controllers. The excavating linkage assembly comprises an excavator boom, an excavator stick, and an implement coupling. The excavating linkage assembly is configured to define a linkage assembly heading $\hat{N}$ and to swing with, or relative to, the machine chassis about a swing axis S of the excavator. The excavator stick is configured to curl relative to the excavator boom about a curl axis C of the excavator. The rotary excavating implement is mechanically coupled to a terminal point G of the excavator stick via the implement coupling and is configured to rotate about a rotary axis R defined by the implement coupling such that a leading edge of the rotary excavating implement defines an implement heading $\hat{I}$. The method further comprises generating, by the one or more dynamic sensors, the one or more controllers, or both, signals that are representative of the linkage assembly heading $\hat{N}$, a swing rate $\omega_S$ of the excavating linkage assembly about the swing axis S, and a curl rate $\omega_C$ of the excavator stick about the curl axis C. Additionally, the method comprises generating, by the one or more dynamic sensors, the one or more controllers, or both, a signal representing a directional heading $\hat{G}$ of the terminal point G of the excavator stick based on the linkage assembly heading $\hat{N}$, the swing rate $\omega_S$ of the excavating linkage assembly, and the curl rate $\omega_C$ of the excavator stick, and rotating, by the one or more controllers and the one or more linkage assembly actuators, the rotary excavating implement about the rotary axis R such that the implement heading $\hat{I}$ approximates the directional heading $\hat{G}$.

Although the concepts of the present disclosure are described herein with primary reference to the excavator illustrated in FIG. 1, it is contemplated that the concepts will enjoy applicability to any type of excavator, regardless of its particular mechanical configuration. For example, and not by way of limitation, the concepts may enjoy applicability to a backhoe loader including a backhoe linkage.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
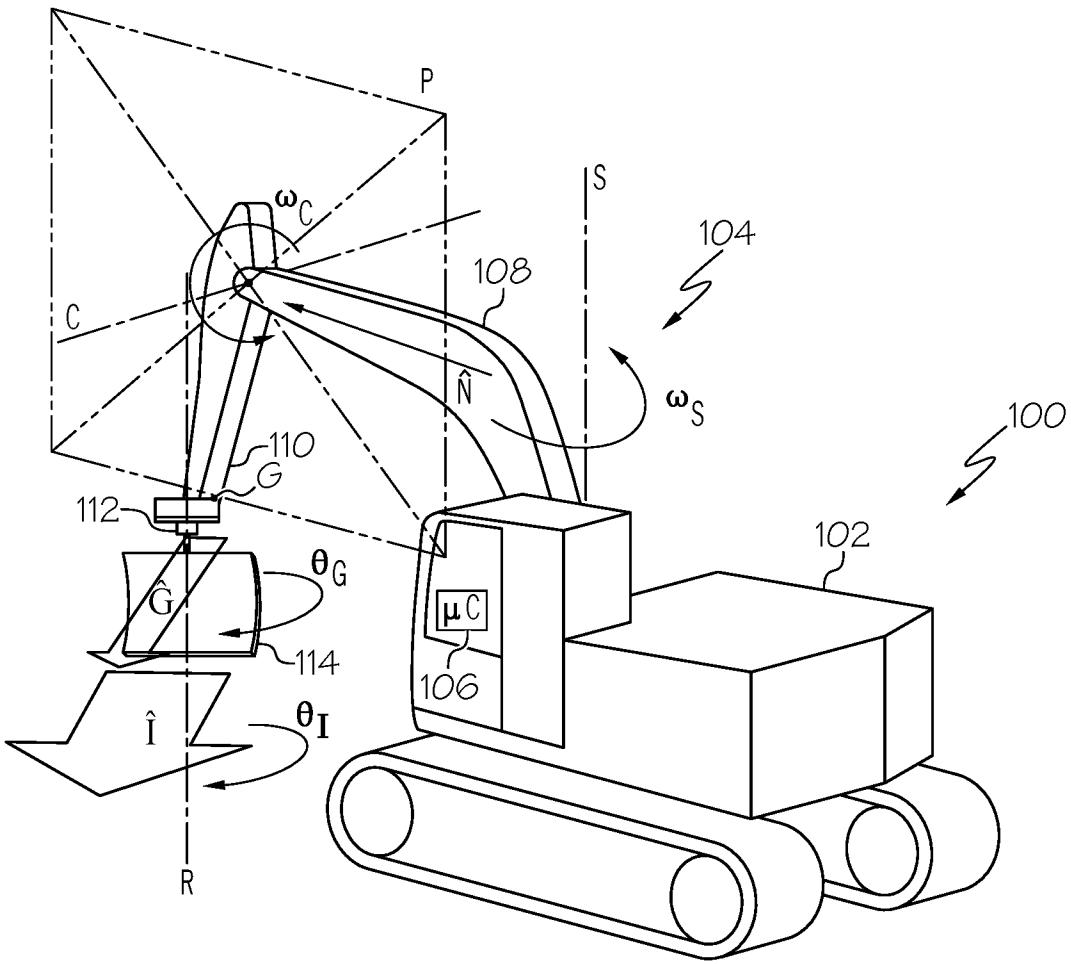
FIG. 1 illustrates an excavator incorporating aspects of the present disclosure.

Referring initially to FIG. 1, which illustrates an excavator 100, it is noted that excavators according to the present disclosure will typically comprise a machine chassis 102, an excavating linkage assembly 104, a rotary excavating implement 114 (e.g., a bucket comprising a cutting edge), and control architecture 106. The excavating linkage assembly 104 may comprise an excavator boom 108, an excavator stick 110, and an implement coupling 112. As non-limiting examples, it is contemplated that the implement coupling 112 may comprise a tilt-rotator attachment such as the Rototilt® RT 60B coupling sold by Indexator AB, of Vindeln, Sweden, and the excavator boom 108 may comprise a variable-angle excavator boom. The excavating linkage assembly 104 may further comprise a power link steering arm and an idler link steering arm.

As will be appreciated by those practicing the concepts of the present disclosure, it is contemplated that the present disclosure may be utilized with 2D and/or 3D automated grade control technologies for excavators. For example, and not by way of limitation, the present disclosure may be used with excavators utilizing the AccuGrade™ Grade Control System incorporating 2D and/or 3D technologies, the GCS900™ Grade Control System incorporating 2D and/or 3D technologies, the GCSFlex™ Grade Control System incorporating 2D and/or 2D plus global positioning system (GPS) technologies, or the Cat® Grade Control System incorporating 2D technologies, each of which is available from Trimble Navigation Limited and/or Caterpillar Inc. as add-on or factory installed excavator features.

The excavating linkage assembly 104 may be configured to define a linkage assembly heading N and to swing with, or relative to, the machine chassis 102 about a swing axis S of the excavator 100. The excavator stick 110 may be configured to curl relative to the excavator boom 108 about a curl axis C of the excavator 100. The excavator boom 108 and excavator stick 110 of the excavator 100 illustrated in FIG. 1 are linked by a simple mechanical coupling that permits movement of the excavator stick 110 in one degree of rotational freedom relative to the excavator boom 108. In these types of excavators, the linkage assembly heading $\hat{N}$ will correspond to the heading of the excavator boom 108. However, the present disclosure also contemplates the use of excavators equipped with offset booms where the excavator boom 108 and excavator stick 110 are linked by a multidirectional coupling that permits movement in more than one rotational degree of freedom. See, for example, the excavator illustrated in U.S. Pat. No. 7,869,923 ("Slewing Controller, Slewing Control Method, and Construction Machine"). In the case of an excavator with an offset boom, the linkage assembly heading $\hat{N}$ will correspond to the heading of the excavator stick 110.

The rotary excavating implement 114 may be mechanically coupled to a terminal point G of the excavator stick 110 via the implement coupling 112 and configured to rotate about a rotary axis R defined by the implement coupling 112 such that a leading edge of the rotary excavating implement 114 defines an implement heading $\hat{I}$.

The control architecture 106 may comprise one or more dynamic sensors, one or more linkage assembly actuators, and one or more controllers. The one or more linkage assembly actuators may facilitate movement of the excavating linkage assembly 104 in either of a manually actuated excavator control system or a partially or fully automated excavator control system. Contemplated actuators include any conventional or yet-to-be developed excavator actuators including, for example, hydraulic cylinder actuators, pneumatic cylinder actuators, electrical actuators, mechanical actuators, or combinations thereof.

Figure 2:
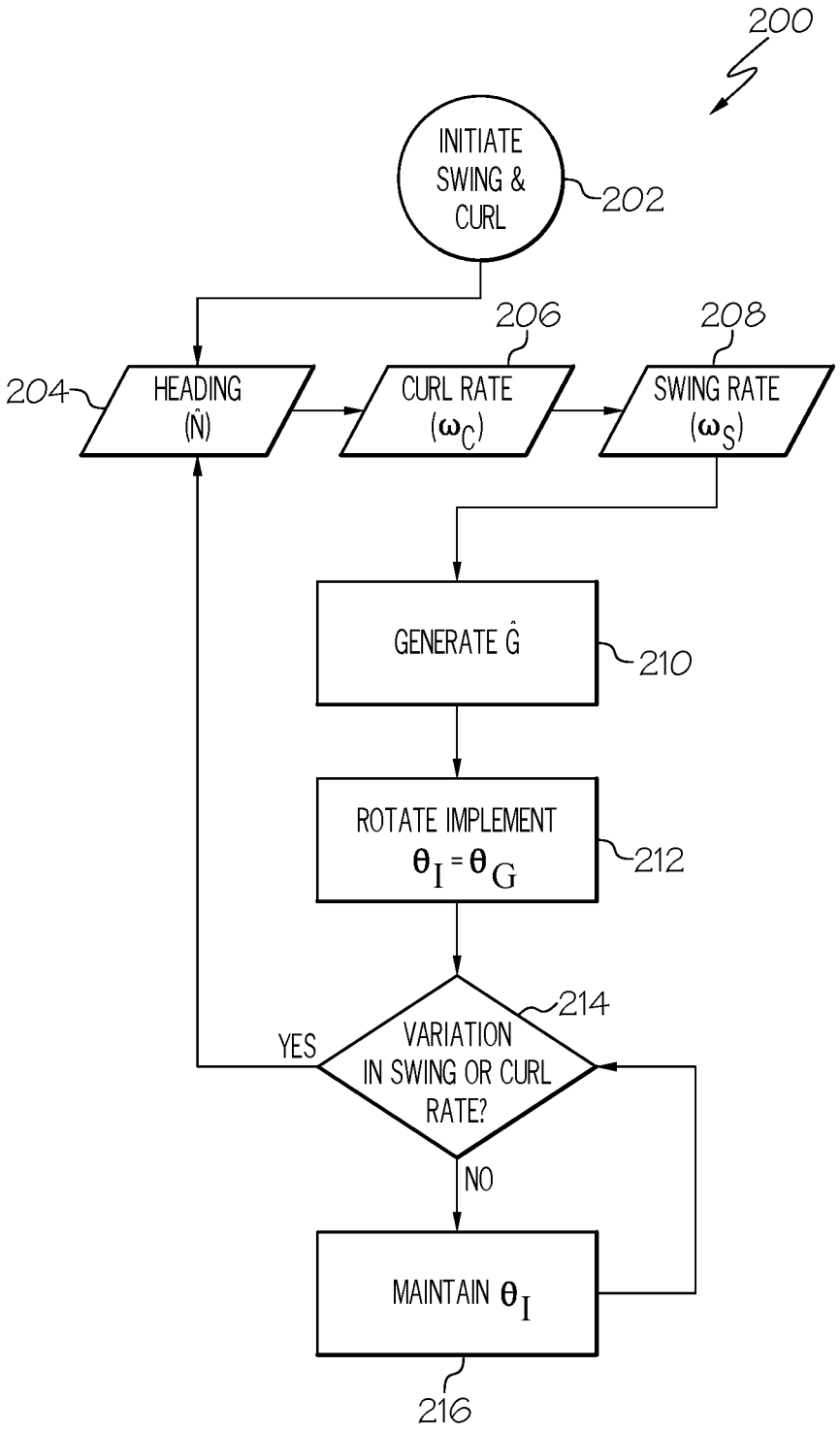
FIG. 2 is a flow chart illustrating instructions implemented by control architecture according to various concepts of the present disclosure.

In one embodiment of the present disclosure, the control architecture 106 comprising one or more controllers programmed to execute machine readable instructions follow a control scheme 200 as shown in FIG. 2, such as to initiate a swing of the excavator 100 and a curl of the excavator stick 110 in step 202. The control architecture 106 may comprise a non-transitory computer-readable storage medium comprising the machine readable instructions. The one or more controllers next generate signals that are representative of the generate signals that are representative of the linkage assembly heading $\hat{N}$, a swing rate $\omega_S$ of the excavating linkage assembly 104 about the swing axis S, and a curl rate $\omega_C$ of the excavator stick 110 about the curl axis C, as shown in steps 204-208. The one or more controllers generate in step 210 a signal representing a directional heading $\hat{G}$ of the terminal point G of the excavator stick 110 based on the linkage assembly heading $\hat{N}$, the swing rate $\omega_S$ of the excavating linkage assembly 104, and the curl rate $\omega_C$ of the excavator stick 110. The one or more controllers then, in step 212, rotate the rotary excavating implement 114 about the rotary axis R such that the implement heading $\hat{I}$ approximates the directional heading $\hat{G}$.

Figures 3, 4, 5, 6, 7:
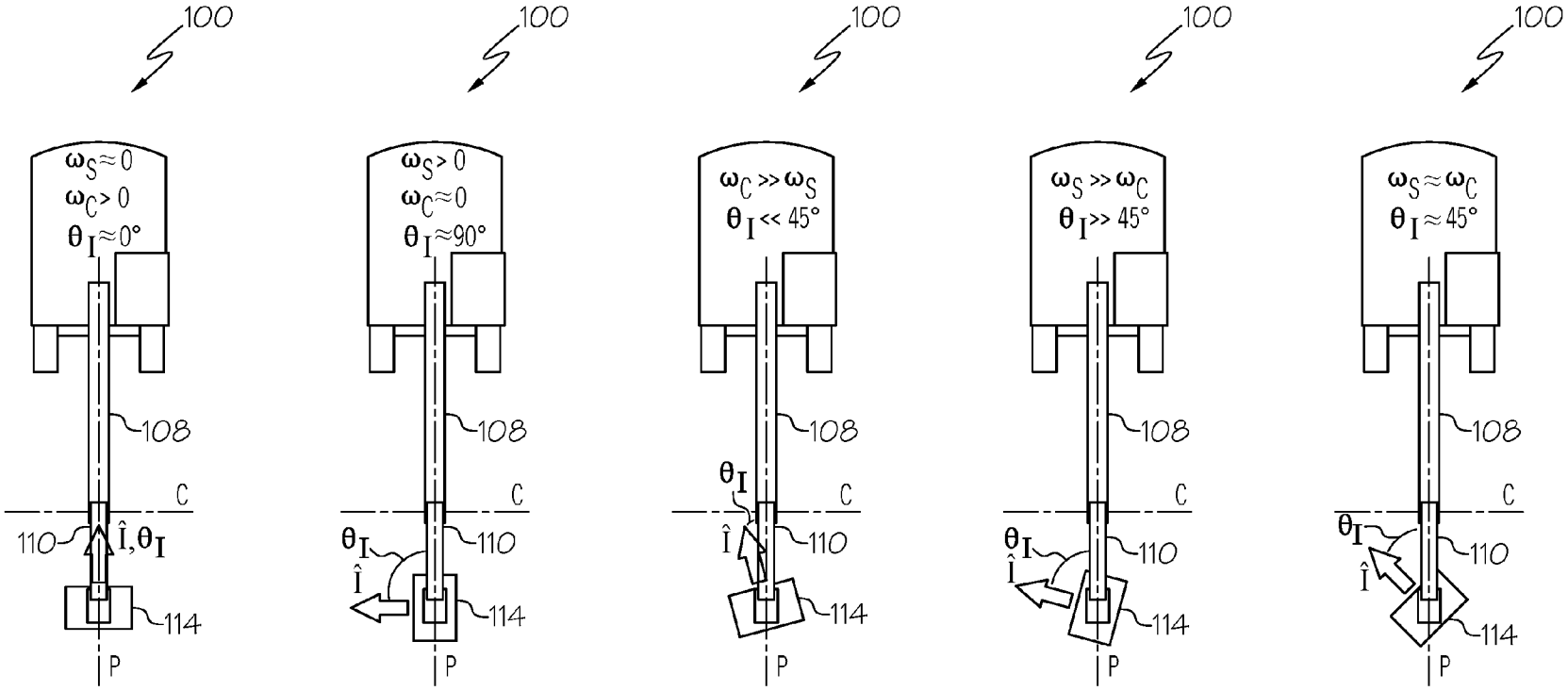
FIGS. 3-7 are top plan views of an excavator illustrating different rotational positions of a rotary excavating implement of the excavator according to various concepts of the present disclosure.

In a contemplated embodiment, the implement heading $\hat{I}$ may define an implement heading angle $\theta_I$ measured between a heading vector of the rotary excavating implement 114 and a reference plane P that is perpendicular to the curl axis C. The directional heading $\hat{G}$ may define a grade heading angle $\theta_G$ measured between a directional heading $\hat{G}$ of the terminal point G of the excavator stick 110 and the reference plane P. Further, the control architecture 106 may execute machine readable instructions to rotate the rotary excavating implement 114 about the rotary axis R such that $\theta_1=\theta_G$. For example, various embodiments of top plan views of the excavator 100 in which the rotary excavating implement 114 is rotated about the rotary axis R such that $\theta_1=\theta_G$ are shown in FIGS. 3-7. Referring to the embodiment of FIG. 3, the implement heading angle $\theta_1$ is approximately 0° when the swing rate $\omega_S$ is approximately zero and the curl rate $\omega_C$ is greater than zero. In the embodiment of FIG. 4, the implement heading angle $\theta_I$ is approximately 90° when the swing rate $\omega_S$ is greater than zero and the curl rate $\omega_C$ is approximately zero. Further, in the embodiment of FIG. 5, the implement heading angle $\theta_I$ is substantially less than 45° when the curl rate $\omega_C$ is substantially greater than the swing rate $\omega_S$. In the embodiment of FIG. 6, the implement heading angle $\theta_1$ is substantially greater than 45° when the swing rate $\omega_S$ is substantially greater than the curl rate $\omega_C$. And in the embodiment of FIG. 7, the implement heading angle $\theta_I$ is approximately 45° when the swing rate $\omega_S$ is approximately equivalent to the curl rate $\omega_C$.

Referring back to FIG. 2, the one or more controllers may further be programmed to execute machine readable instructions to regenerate the directional heading $\hat{G}$ when there is a variation in the a swing rate $\omega_S$, the curl rate $\omega_C$, or both, as shown in step 214, to adjust the rotation of the rotary excavating implement 114 such that the implement heading $\hat{I}$ approximates the regenerated directional heading $\hat{G}$. When there is no variation in the a swing rate $\omega_S$, the curl rate $\omega_C$, or both, the one or more controllers may be programmed to execute machine readable instructions to maintain the directional heading $\hat{G}$ and thus maintain the implement heading angle $\theta_1$ as shown in step 216.

In another contemplated embodiment, the control architecture 106 may comprise a heading sensor, a swing rate sensor, and a curl rate sensor configured to generate the linkage assembly heading $\hat{N}$, swing rate $\omega_S$, and curl rate $\omega_C$, respectively. The dynamic sensors may comprise a GPS sensor, a global navigation satellite system (GNSS) receiver, a Universal Total Station (UTS) and machine target, a laser scanner, a laser receiver, an inertial measurement unit (IMU), an inclinometer, an accelerometer, a gyroscope, an angular rate sensor, a magnetic field sensor, a magnetic compass, a rotary position sensor, a position sensing cylinder, or combinations thereof. As will be appreciated by those practicing the concepts of the present disclosure, contemplated excavators may employ one or more of a variety of conventional or yet-to-be developed dynamic sensors.

As an example, and not a limitation, the dynamic sensor may comprise a heading sensor configured to generate the linkage assembly heading $\hat{N}$, the directional heading $\hat{G}$ of the terminal point G, or both, and the heading sensor may comprise a GNSS receiver, a UTS and machine target, an IMU, an inclinometer, an accelerometer, a gyroscope, a magnetic field sensor, or combinations thereof. It is contemplated that the heading sensor may comprise any conventional or yet-to-be developed sensor suitable for generating a signal representing a heading of a component of the excavator 100 such as the excavator boom 108, the excavator stick 110, and/or the rotary excavating implement 114 relative to respective predetermined reference points or vectors in a three-dimensional space, for example.

Additionally or alternatively, the dynamic sensor comprises a swing rate sensor mounted to a swinging portion of the machine chassis 102, the excavating linkage assembly 104, or both, to generate the swing rate $\omega_S$, and the swing rate sensor may comprise a GNSS receiver, a UTS and machine target, an IMU, an inclinometer, an accelerometer, a gyroscope, an angular rate sensor, a gravity based angle sensor, an incremental encoder, or combinations thereof. It is contemplated that the swing rate sensor may comprise any conventional or yet-to-be developed sensor suitable for generating a signal representing the degree of swing or rotation of the machine chassis 102 relative to a predetermined reference point or vector, or rotation about a plane in a three-dimensional space, such as the swing axis S, for example. It is further contemplated that the swing rate sensor may be a stand-alone sensor or be part of another sensor to generate a swing rate $\omega_S$, such as being part of the heading sensor to calculate a swing rate $\omega_S$ based on, for example, a rate of change of an angle associated with the linkage assembly heading $\hat{N}$. It is contemplated that any of the sensors described herein may be stand-alone sensors or may be part of a combined sensor unit and/or may generate measurements based on readings from one or more other sensors.

In embodiments, the dynamic sensor may comprise a curl rate sensor mounted to a curling portion of the excavating linkage assembly 104 to generate the curl rate $\omega_C$, and the curl rate sensor may comprise an IMU, an inclinometer, an accelerometer, a gyroscope, an angular rate sensor, a gravity based angle sensor, an incremental encoder, a position sensing cylinder, or combinations thereof. It is contemplated that the curl rate sensor may comprise any conventional or yet-to-be developed sensor suitable for generating a signal representing the degree of curl or rotation of the excavator stick 110 relative to a predetermined reference point or vector, or rotation about a plane in a three-dimensional space, such as the curl axis C, for example.

In a contemplated embodiment, the dynamic sensor may comprise a rotation angle sensor configured to generate a signal representing a rotation angle of the rotary excavating implement 114. It is contemplated that the rotation angle sensor may comprise any conventional or yet-to-be developed sensor suitable for generating a signal representing the degree of rotation of the rotary excavating implement 114 relative to the reference plane P. For example, and not as a limitation, the dynamic sensors may be any conventional or yet-to-be developed sensors suitable to be configured to calculate the angles and positions of at least a pair of the excavator boom 108, the excavator stick 110, the implement coupling 112, and a tip of the rotary excavating implement 114 with respect to one another, with respect to a benched reference point, or both.

Figure 8:
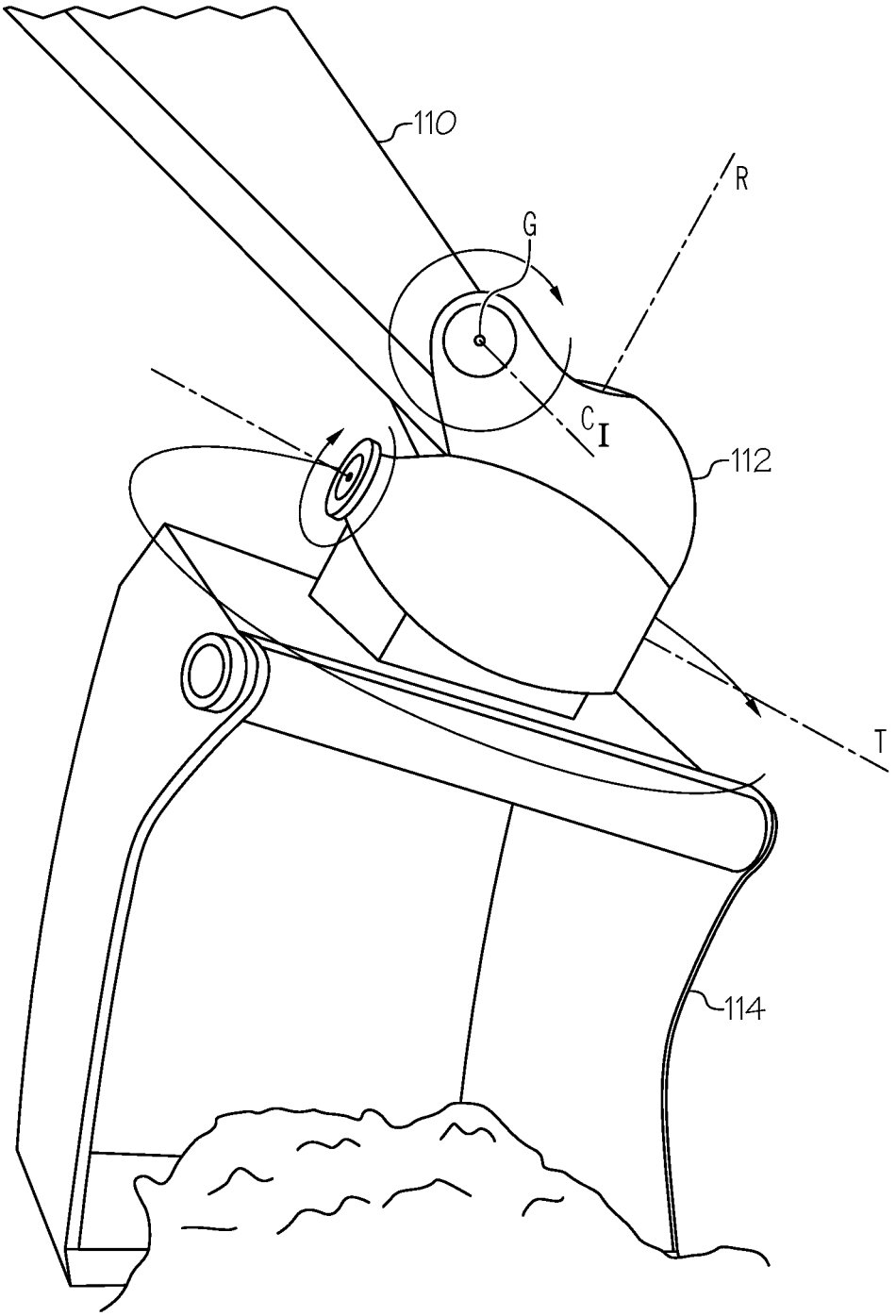
FIG. 8 is an isometric illustration of a rotary excavating implement.

In another contemplated embodiment, the implement coupling 112 may comprise a tilt-rotator attachment that is structurally configured to enable rotation and tilt of the rotary excavating implement 114. For example, referring to FIG. 8, the rotary axis R about which the rotary excavating implement 114 rotates bisects the implement coupling 112, as do an implement curl axis $C_I$ and an implement tilt axis T about which the rotary excavating implement 114 may respectively curl and tilt.

The dynamic sensors may comprise a tilt angle sensor configured to generate a signal representing a tilt angle of the rotary excavating implement 114. Further, the control architecture 106 may comprise a grade control system responsive to signals generated by the dynamic sensors and configured to execute machine readable instructions to control the tilt angle of the rotary excavating implement 114 via the tilt-rotator attachment to follow the design of a slope for a final graded surface stored in the grade control system. As the bucket is rotated, the system will compare the bucket's tilt angle to a target slope as defined in the grade control system and will automatically command the tilt-rotator attachment to tilt the bucket in a direction which would result in the bucket tilt angle matching the design surface. For example, and not by way of limitation, suitable grade control systems are illustrated in U.S. Pat. No. 7,293,376, which is assigned to Caterpillar Inc. and discloses a grading control system for an excavator.

It is contemplated that the embodiments of the present disclosure may assist to reduce operator fatigue by providing for an excavating heading implement control that may be partially or fully automated and may further result in improved operator and machine productivity and reduced fuel consumption, and reduced wear and tear of the machine by such efficient machine usage, for example.

For the purposes of describing and defining the present invention, it is noted that reference herein to a variable being "based" on a parameter or another variable is not intended to denote that the variable is exclusively based on the listed parameter or variable. Rather, reference herein to a variable that is a "based on" a listed parameter is intended to be open ended such that the variable may be based on a single parameter or a plurality of parameters. Further, it is noted that, a signal may be "generated" by direct or indirect calculation or measurement, with or without the aid of a sensor.

It is noted that recitations herein of a component of the present disclosure being "configured" or "programmed" in a particular way, to embody a particular property, or to function in a particular manner, are structural recitations, as opposed to recitations of intended use. More specifically, the references herein to the manner in which a component is "configured" or "programmed" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "approximately" are utilized herein to represent the inherent degree of uncertainty that may be attributed to any quantitative comparison, value, measurement, or other representation. For example, an angle may be approximately zero degrees (0°) or another numeric value that is greater than zero degrees such as 45°. The terms "substantially" and "approximately" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. An excavator comprising a machine chassis, an excavating linkage assembly, a rotary excavating implement, and control architecture, wherein:

the excavating linkage assembly comprises an excavator boom, an excavator stick, and an implement coupling;

the excavating linkage assembly is configured to define a linkage assembly heading ($\hat{N}$) and to swing with, or relative to, the machine chassis about a swing axis (S) of the excavator;

the excavator stick is configured to curl relative to the excavator boom about a curl axis (C) of the excavator;

the rotary excavating implement is mechanically coupled to a terminal point (G) of the excavator stick via the implement coupling and is configured to rotate about a rotary axis (R) defined by the implement coupling such that a leading edge of the rotary excavating implement defines an implement heading ($\hat{I}$); and the control architecture comprises one or more dynamic sensors, one or more linkage assembly actuators, and one or more controllers programmed to execute machine readable instructions to generate signals that are representative of the linkage assembly heading ($\hat{N}$), a swing rate ($\omega_S$) of the excavating linkage assembly about the swing axis (S), and a curl rate ($\omega_C$) of the excavator stick about the curl axis (C), generate a signal representing a directional heading ($\hat{G}$) of the terminal point (G) of the excavator stick based on the linkage assembly heading ($\hat{N}$), the swing rate ($\omega_S$) of the excavating linkage assembly, and the curl rate ($\omega_C$) of the excavator stick, and rotate the rotary excavating implement about the rotary axis (R) such that the implement heading ($\hat{I}$) approximates the directional heading ($\hat{G}$).

2. The excavator as claimed in claim 1 wherein:

the implement heading ($\hat{I}$) defines an implement heading angle ($\theta_I$) measured between a heading vector of the rotary excavating implement and a reference plane (P) that is perpendicular to the curl axis (C);

the directional heading ($\hat{G}$) defines a grade heading angle ($\theta G$) measured between the directional heading ($\hat{G}$) of the terminal point (G) of the excavator stick and the reference plane (P); and the control architecture executes machine readable instructions to rotate the rotary excavating implement about the rotary axis (R) such that $\theta_I=\theta_G$.

3. The excavator as claimed in claim 2 wherein the implement heading angle ($\theta_I$) is approximately 0° when the swing rate ($\omega_S$) is approximately zero and the curl rate ($\omega_C$) is greater than zero.

4. The excavator as claimed in claim 2 wherein the implement heading angle ($\theta_I$) is approximately 90° when the swing rate ($\omega_S$) is greater than zero and the curl rate ($\omega_C$) is approximately zero.

5. The excavator as claimed in claim 2 wherein the implement heading angle ($\theta_I$) is substantially less than 45° when the curl rate ($\omega_C$) is substantially greater than the swing rate ($\omega_S$).

6. The excavator as claimed in claim 2 wherein the implement heading angle ($\theta_I$) is substantially greater than 45° when the swing rate ($\omega_S$) is substantially greater than the curl rate ($\omega_C$).

7. The excavator as claimed in claim 2 wherein the implement heading angle ($\theta_I$) is approximately 45° when the swing rate ($\omega_S$) is approximately equivalent to the curl rate ($\omega_C$).

8. The excavator as claimed in claim 1 wherein the one or more controllers are programmed to execute machine readable instructions to:

regenerate the directional heading ($\hat{G}$) when there is a variation in the swing rate ($\omega_S$), the curl rate ($\omega_C$), or both; and adjust the rotation of the rotary excavating implement such that the implement heading ($\hat{I}$) approximates the regenerated directional heading ($\hat{G}$).

9. The excavator as claimed in claim 1 wherein the control architecture comprises a heading sensor, a swing rate sensor, and a curl rate sensor configured to generate the linkage assembly heading the swing rate ($\omega_S$), and the curl rate ($\omega_C$), respectively.

10. The excavator as claimed in claim 1 wherein the control architecture comprises a non-transitory computer-readable storage medium comprising the machine readable instructions.

11. The excavator as claimed in claim 1 wherein the one or more linkage assembly actuators facilitate movement of the excavating linkage assembly.

12. The excavator as claimed in claim 11 wherein the one or more linkage assembly actuators comprise a hydraulic cylinder actuator, a pneumatic cylinder actuator, an electrical actuator, a mechanical actuator, or combinations thereof.

13. The excavator as claimed in claim 1 wherein the one or more dynamic sensors comprise a global navigation satellite system (GNSS) receiver, a Universal Total Station (UTS) and machine target, an inertial measurement unit (IMU), an inclinometer, an accelerometer, a gyroscope, an angular rate sensor, a rotary position sensor, a position sensing cylinder, or combinations thereof.

14. The excavator as claimed in claim 1 wherein:

the one or more dynamic sensors comprise a heading sensor configured to generate the linkage assembly heading ($\hat{N}$), the directional heading ($\hat{G}$) of the terminal point (G), or both; and the heading sensor comprises a global navigation satellite system (GNSS) receiver, a Universal Total Station (UTS) and machine target, an inertial measurement unit (IMU), an inclinometer, an accelerometer, a gyroscope, a magnetic compass, or combinations thereof.

15. The excavator as claimed in claim 1 wherein:

the one or more dynamic sensors comprise a swing rate sensor mounted to a swinging portion of the machine chassis, the excavating linkage assembly, or both, to generate the swing rate ($\omega_S$); and the swing rate sensor comprises a global navigation satellite system (GNSS) receiver, a Universal Total Station (UTS) and machine target, an inertial measurement unit (IMU), an inclinometer, an accelerometer, a gyroscope, an angular rate sensor, a gravity based angle sensor, an incremental encoder, or combinations thereof.

16. The excavator as claimed in claim 1 wherein:

the one or more dynamic sensors comprise a curl rate sensor mounted to a curling portion of the excavating linkage assembly to generate the curl rate ($\omega_C$); and the curl rate sensor comprises an inertial measurement unit (IMU), an inclinometer, an accelerometer, a gyroscope, an angular rate sensor, a gravity based angle sensor, an incremental encoder, or combinations thereof.

17. The excavator as claimed in claim 1 wherein the one or more dynamic sensors comprise a rotation angle sensor configured to generate a signal representing a rotation angle of the rotary excavating implement.

18. The excavator as claimed in claim 17 wherein the one or more dynamic sensors are configured to calculate the angles and positions of at least two pieces of equipment of: the excavator boom, the excavator stick, the implement coupling, and a tip of the rotary excavating implement, wherein angles and positions of the at least two pieces of equipment are calculated with respect to one another, or each piece of equipment with respect to a benched reference point for each piece of equipment, or both.

19. The excavator as claimed in claim 1 wherein:

the implement coupling comprises a tilt-rotator attachment that is structurally configured to enable rotation and tilt of the rotary excavating implement;

the one or more dynamic sensors comprise a tilt angle sensor configured to generate a signal representing a tilt angle of the rotary excavating implement; and the control architecture comprises a grade control system responsive to signals generated by the one or more dynamic sensors and is configured to execute machine readable instructions to control the tilt angle of the rotary excavating implement via the tilt-rotator attachment to follow a design of a slope for a final graded surface stored in the grade control system.

20. A method of automating tilt and rotation of a rotary excavating implement of an excavator, the method comprising:

providing an excavator comprising a machine chassis, an excavating linkage assembly, a rotary excavating implement, and control architecture comprising one or more dynamic sensors, one or more linkage assembly actuators, and one or more controllers, wherein:

the excavating linkage assembly comprises an excavator boom, an excavator stick, and an implement coupling;

the excavating linkage assembly is configured to define a linkage assembly heading ($\hat{N}$) and to swing with, or relative to, the machine chassis about a swing axis (S) of the excavator;

the excavator stick is configured to curl relative to the excavator boom about a curl axis (C) of the excavator;

the rotary excavating implement is mechanically coupled to a terminal point (G) of the excavator stick via the implement coupling and is configured to rotate about a rotary axis (R) defined by the implement coupling such that a leading edge of the rotary excavating implement defines an implement heading ($\hat{I}$); and generating, by the one or more dynamic sensors, the one or more controllers, or both, signals that are representative of the linkage assembly heading ($\hat{N}$), a swing rate ($\omega_S$) of the excavating linkage assembly about the swing axis (S), and a curl rate ($\omega_C$) of the excavator stick about the curl axis (C), generating, by the one or more dynamic sensors, the one or more controllers, or both, a signal representing a directional heading ($\hat{G}$) of the terminal point (G) of the excavator stick based on the linkage assembly heading ($\hat{N}$), the swing rate ($\omega_S$) of the excavating linkage assembly, and the curl rate ($\omega_C$) of the excavator stick, and rotating, by the one or more controllers and the one or more linkage assembly actuators, the rotary excavating implement about the rotary axis (R) such that the implement heading ($\hat{I}$) approximates the directional heading ($\hat{G}$).

* * * * *